US011158237B2

(12) United States Patent
Xiang et al.

(10) Patent No.: US 11,158,237 B2
(45) Date of Patent: Oct. 26, 2021

(54) DRIVING METHOD FOR DISPLAY PANEL, AND DISPLAY DEVICE BASED ON VIEWING DISTANCE

(71) Applicants: Beijing BOE Optoelectronics Technology Co., Ltd., Beijing (CN); BOE Technology Group Co., Ltd., Beijing (CN)

(72) Inventors: Desheng Xiang, Beijing (CN); Dawei Wang, Beijing (CN); Jingfei Mu, Beijing (CN); Jiaqiang Wang, Beijing (CN); Lidong Wang, Beijing (CN); Dong Wang, Beijing (CN)

(73) Assignees: Beijing BOE Optoelectronics Technology Co., Ltd., Beijing (CN); BOE Technology Group Co., Ltd., Beijing (CN)

( * ) Notice: Subject to any disclaimer, the term of this patent is extended or adjusted under 35 U.S.C. 154(b) by 0 days.

(21) Appl. No.: 16/969,326

(22) PCT Filed: Dec. 6, 2019

(86) PCT No.: PCT/CN2019/123756
§ 371 (c)(1),
(2) Date: Aug. 12, 2020

(87) PCT Pub. No.: WO2020/147452
PCT Pub. Date: Jul. 23, 2020

(65) Prior Publication Data

US 2021/0074200 A1 Mar. 11, 2021

(30) Foreign Application Priority Data

Jan. 18, 2019 (CN) ..... 201910048637.0

(51) Int. Cl.
*G09G 3/20* (2006.01)
*G09G 3/3208* (2016.01)

(52) U.S. Cl.
CPC ..... *G09G 3/2085* (2013.01); *G09G 3/2003* (2013.01); *G09G 3/3208* (2013.01);
(Continued)

(58) Field of Classification Search
CPC .. G09G 3/2085; G09G 3/2003; G09G 3/3208; G09G 2300/0452;
(Continued)

(56) References Cited

U.S. PATENT DOCUMENTS

2011/0279493 A1* 11/2011 Phan ..... G09G 3/2003 345/694
2012/0062624 A1 3/2012 Zhu
(Continued)

FOREIGN PATENT DOCUMENTS

CN 101923826 A 12/2010
CN 102402954 A 4/2012
(Continued)

OTHER PUBLICATIONS

Office Action for corresponding Chinese Application 201910048637.0 dated Mar. 5, 2020.
(Continued)

*Primary Examiner* — Richard J Hong
(74) *Attorney, Agent, or Firm* — Arent Fox LLP; Michael Fainberg

(57) ABSTRACT

Disclosed are a driving method for a display panel, and a display device based on a viewing distance. The display panel includes a plurality of pixels arranged in an array, and each pixel includes sub-pixels of at least three colors. A viewing distance is acquired between a user and the display panel; the number of pixels to be lightened in the display
(Continued)

panel is determined based on the viewing distance; the larger the viewing distance is, the smaller the number of pixels to be lightened in the display panel is; and displaying is performed based on the determined number of pixels to be lightened.

15 Claims, 16 Drawing Sheets

(52) U.S. Cl.
CPC ..... *G09G 2300/0452* (2013.01); *G09G 2320/0233* (2013.01); *G09G 2330/023* (2013.01); *G09G 2340/0407* (2013.01)

(58) Field of Classification Search
CPC ..... G09G 2320/0233; G09G 2330/023; G09G 2340/0407; G09G 5/00; H04N 21/4436; G06T 11/00; G06F 3/005; G06F 3/0484
See application file for complete search history.

(56) References Cited

U.S. PATENT DOCUMENTS

| | | | | |
|---|---|---|---|---|
| 2012/0293496 | A1 | 11/2012 | Park et al. | |
| 2015/0179150 | A1* | 6/2015 | Andrysco | G06F 3/005 345/156 |
| 2015/0213768 | A1 | 7/2015 | Jung | |
| 2015/0213786 | A1* | 7/2015 | Mamajiwala | G09G 5/00 345/428 |
| 2015/0248210 | A1* | 9/2015 | Lee | H04N 21/4436 345/593 |
| 2016/0253955 | A1 | 9/2016 | Wu et al. | |
| 2017/0132990 | A1 | 5/2017 | He et al. | |
| 2019/0027112 | A1* | 1/2019 | Hsu | G06T 11/00 |
| 2019/0027118 | A1* | 1/2019 | Zuo | G06F 3/0484 |
| 2019/0279574 | A1 | 9/2019 | Kim et al. | |

FOREIGN PATENT DOCUMENTS

| | | | |
|---|---|---|---|
| CN | 103439824 | A | 12/2013 |
| CN | 104103240 | A | 10/2014 |
| CN | 104505041 | A | 4/2015 |
| CN | 104933983 | A | 9/2015 |
| CN | 106875890 | A | 6/2017 |
| CN | 106991985 | A | 7/2017 |
| CN | 107465815 | A | 12/2017 |
| CN | 107633813 | A | 1/2018 |
| CN | 107731179 | A | 2/2018 |
| CN | 107886850 | A | 4/2018 |
| CN | 109559673 | A | 4/2019 |

OTHER PUBLICATIONS

Office Action for corresponding Chinese Application 201910048637.0 dated May 15, 2020.
Office Action for corresponding Chinese Application 201910048637.0 dated Sep. 14, 2020.

* cited by examiner

DRIVING METHOD FOR DISPLAY PANEL, AND DISPLAY DEVICE BASED ON VIEWING DISTANCE

This application is a National Stage of International Application No. PCT/CN2019/123756, filed on Dec. 6, 2019, which claims for the priority of Chinese patent application filed with Patent Office on Jan. 18, 2019, with the application number of 201910048637.0 and titled "METHOD FOR DRIVING DISPLAY PANEL AND DISPLAY DEVICE", and the entire contents of which are incorporated by reference in this application.

FIELD

The present disclosure relates to the field of display technologies, and more particularly to a method for driving a display panel and a display device.

BACKGROUND

With the development of display technology, people have put forward higher and higher requirements on the definition of display panels. Therefore, high-resolution display panels become increasingly popular.

SUMMARY

The present disclosure provides a driving method for a display panel and a display device. The specific solutions will be described in embodiments below.

An embodiment of the present disclosure provides a driving method of a display panel, wherein the display panel includes a plurality of pixels arranged in an array, each of the pixels including sub-pixels of at least three colors, the method includes:

acquiring a viewing distance between a viewer and the display panel;

determining a quantity of pixels to be lightened in the display panel based on the viewing distance; wherein larger the viewing distance is, smaller the quantity of pixels to be lightened in the display panel is; and displaying based on determined quantity of pixels to be lightened.

In some embodiments, the determining the quantity of pixels to be lightened in the display panel based on the viewing distance includes:

determining the quantity of pixels to be lightened in the display panel based on the viewing distance and a corresponding relationship between preset distance ranges and quantities of pixels to be lightened;

wherein the quantities of pixels to be lightened corresponding to the preset distance ranges are different, and larger the distance range is, smaller the quantity of the pixels to be lightened is.

In some embodiments, the determining the quantity of pixels to be lightened in the display panel based on the viewing distance and the corresponding relationship lightened includes:

determining a distance range to which the viewing distance belongs; and determining the quantity of pixels to be lightened in the display panel by searching the corresponding relationship between the preset distance ranges and the quantities of pixels to be lightened based on determined distance range.

In some embodiments, the displaying based on the determined quantity of pixels to be lightened includes:

determining positions of pixels to be lightened based on the determined quantity of pixels to be lightened; and displaying based on the positions of pixels to be lightened and a data signal corresponding to the pixels to be lightened.

In some embodiments, the determining the positions of pixels to be lightened based on the determined quantity of pixels to be lightened includes:

in response to that the quantity of pixels to be lightened is M/N of a total quantity of pixels in the display panel, grouping every adjacently arranged N pixels as a pixel unit, and each of the pixel units comprise M pixels to be lightened; wherein N is an integer greater than 1, and M is a positive integer smaller than N.

In some embodiments, M=1, the pixel to be lightened is composed of one of the pixels in the pixel unit.

In some embodiments, the N pixels in the pixel unit are sequentially adjacent in a row direction; and in two pixel units adjacent in a column direction, two pixels to be lightened are located in different columns.

In some embodiments, a quantity of non-lightened pixels between any two adjacent pixels to be lightened in the row direction are same.

In some embodiments, N pixels in the pixel unit are sequentially adjacent in a column direction; and in two pixel units adjacent in the row direction, the two pixels to be lightened are located in different rows.

In some embodiments, quantities of non-lightened pixels between any two adjacent pixels to be lightened in the column direction are same.

In some embodiments, M=1, and the pixel to be lightened is composed of sub-pixels in different pixels in the pixel unit.

In some embodiments, quantities of non-lighten sub-pixels lightened between any two sub-pixels to be lightened adjacent in a row direction are same.

In some embodiments, all the sub-pixels in the pixels are subsequently arranged in the row direction, and the sub-pixels in a same column have same color; and in response to that N is smaller than the quantity of sub-pixels in the pixel, the pixel to be lightened is composed of sub-pixels of the N pixels in the pixel unit.

In some embodiments, all the sub-pixels in the pixels are sequentially arranged in the row direction, and the sub-pixels in a same column the same color; and in response to that N is greater than or equal to the quantity of sub-pixels in the pixel, the sub-pixels to be lightened belong to different pixels of the pixel units, respectively.

In some embodiments, the determining the positions of the pixel to be lightened based on the determined quantity of pixels to be lightened includes:

in response to that the quantity of pixels to be lightened is M/N of the total number of pixels in the display panel, selecting an area to be displayed, wherein an area of the area to be displayed is M/N of an area of the display area of the display panel, and a shape of the area to be displayed is similar to a shape of the display area, and the two shapes coincide at center; N is an integer greater than 1 and M is a positive integer smaller than N; and wherein the pixels to be lightened comprises the pixels in the area to be displayed.

Accordingly, the present embodiment further provides a display device including a display panel, wherein the display panel is driven by the method according to above embodiments of the present disclosure.

In some embodiments, the display panel includes a display area and an abnormal shaped area, and a boundary line between the display area and the abnormal shaped area is at least partially arc shaped.

DETAILED DESCRIPTION OF THE EMBODIMENTS

Figure 1:
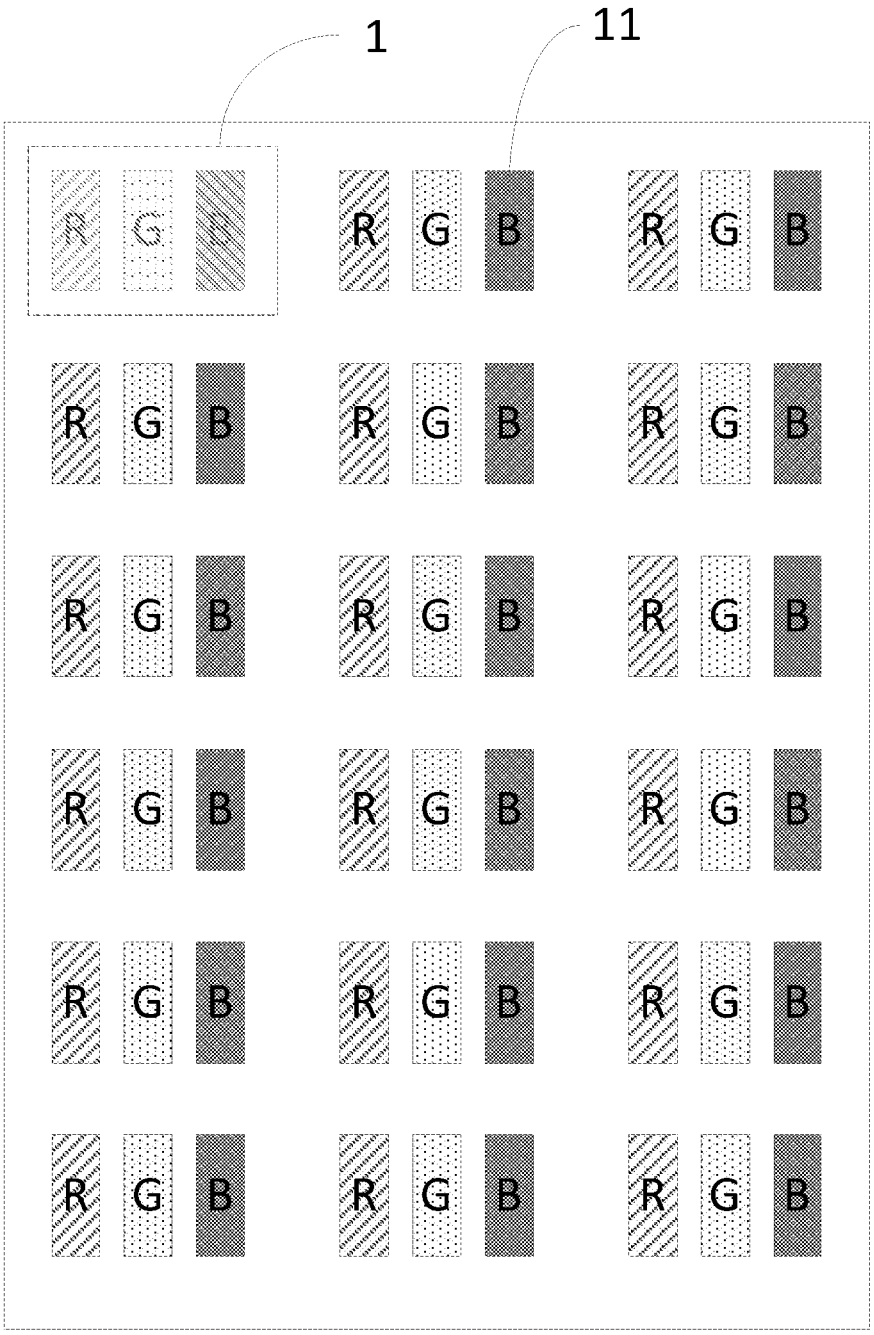
FIG. 1 is a schematic structural diagram of a manner of arranging sub-pixels in a display panel according to an embodiment of the present disclosure.

As to the problem in related technology that the energy consumption of the high-resolution display panel is too high, some embodiments of the disclosure provide a method for driving a display panel and a display device. In order to make the objective, the technology solutions and the advantages of the present disclosure more clear, the present disclosure will be further described in detail with reference to the accompanying drawings. Obviously, all embodiments described are just a part but not all of the embodiments disclosed in present disclosure. All other embodiments acquired by those skilled in the art based on the embodiments of the present disclosure without creative efforts fall into the scope of the present disclosure.

The shapes and sizes of the various components in the drawings do not reflect true proportions, and are merely intended to illustrate the present disclosure.

Figure 2:
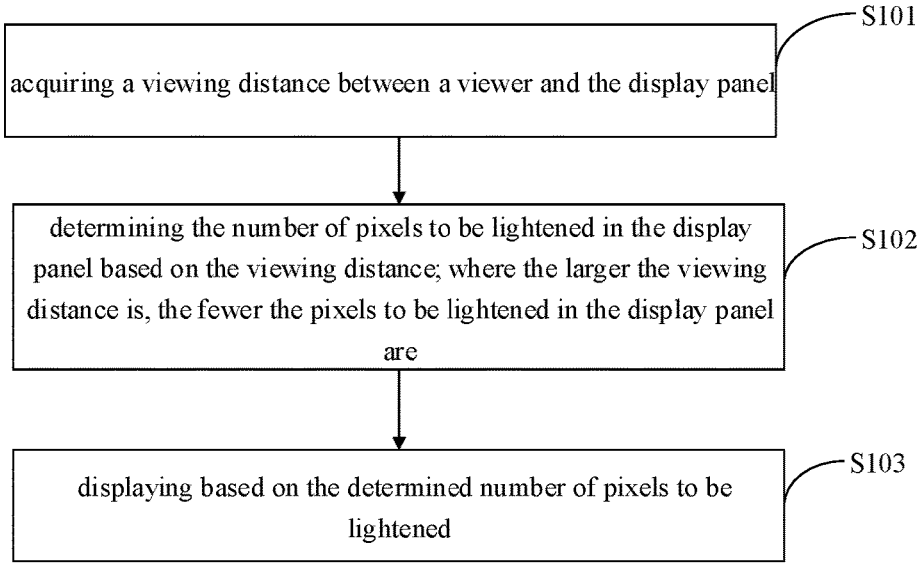
FIG. 2 is a flowchart of a method for driving a display panel according to an embodiment of the present disclosure.

An embodiment of the present disclosure provides a method for driving a display panel, wherein as shown in FIG. 1, the display panel includes a plurality of pixels 1 arranged in an array, each pixel including sub-pixels 11 of at least three colors. As shown in FIG. 2, the method includes:

S101, a viewing distance between a viewer and the display panel is acquired;

S102, the number of pixels to be lightened in the display panel is determined based on the viewing distance; wherein the larger the viewing distance is, the smaller the number of pixels to be lightened in the display panel is; and S103, display is performed based on the determined number of pixels to be lightened.

An embodiment of the present disclosure provides a driving method of a display panel, wherein the display panel includes a plurality of pixels arranged in an array, each pixel includes sub-pixels of at least three colors, and the method includes: a viewing distance between a viewer and a display panel is acquired; the number of pixels to be lightened in the display panel is determined based on the viewing distance; wherein the larger the viewing distance is, the smaller the number of pixels to be lightened in the display panel is; and display is performed based on the determined number of pixels to be lightened. That is to say, the positions and numbers of sub-pixels to be lightened in the display panel are determined based on the distance between the viewer and the display panel. The display panel performs high-resolution display when the distance is relatively close and performs low-resolution display when the distance is relatively far, so that the energy consumption of the display panel is lowered.

The viewing distance between the viewer and the display panel can be acquired by using a distance sensor built in the display panel. The distance sensor can be an optical displacement sensor, an ultrasonic displacement sensor, and so on, which is not specifically limited.

Alternatively, in some embodiments, wherein the step that the number of pixels to be lightened in the display panel is determined based on the acquired viewing distance includes:

the number of pixels to be lightened in the display panel is determined based on the viewing distance and the corresponding relationship between preset different distance ranges and the numbers of pixels to be lightened;

wherein, the numbers of pixels to be lightened corresponding to different distance ranges are different, and the larger the distance range is, the smaller the number of the corresponding pixels to be lightened is.

In some embodiments, the different numbers of pixels to be lightened in the display panel represent different resolutions of the display panel during display. The greater the number of pixels to be lightened is, the higher the resolution is during display.

In the present disclosure, in the corresponding relationship between the preset different distance ranges and the numbers of pixels to be lightened, the more the distance ranges are set within a certain range, the more the display resolutions the display panel has, and the viewing result can be guaranteed on the basis of energy saving. In some embodiments, it can be set according to practical experience. For example, 0~K1 is a distance range, when the number of pixels to be lightened is the number of all pixels in the display panel, corresponding display resolution is the highest. K1~K2 is a distance range, when the number of pixels to be lightened is the number of most pixels in the display panel, corresponding display resolution is lower. K2~∞ is a distance range, when the number of pixels to be lightened is the number of a small part of pixels in the display panel, corresponding display resolution is the lowest.

Alternatively, in some embodiments, the step that the number of pixels to be lightened in the display panel is determined based on the viewing distance and the corresponding relationship between the preset different distance ranges and the numbers of pixels to be lightened includes:

the distance range to which the viewing distance belongs is determined; and the number of pixels to be lightened in the display panel is determined by searching the corresponding relationship between the preset different distance ranges and the numbers of pixels to be lightened based on the determined distance range.

The following will be explained in detail as an example to describe the driving method of the display panel described in the embodiment of the present disclosure: 0~K1 is taken as a distance range and the number of pixels to be lightened is X1, K1~K2 is taken as a distance range and the number of pixels to be lightened is X2, and K2~∞ is taken as a distance range and the number of pixels to be lightened is X3, wherein X1 is the number of all pixels in the display panel, and X1>X2>X3.

Figure 3:
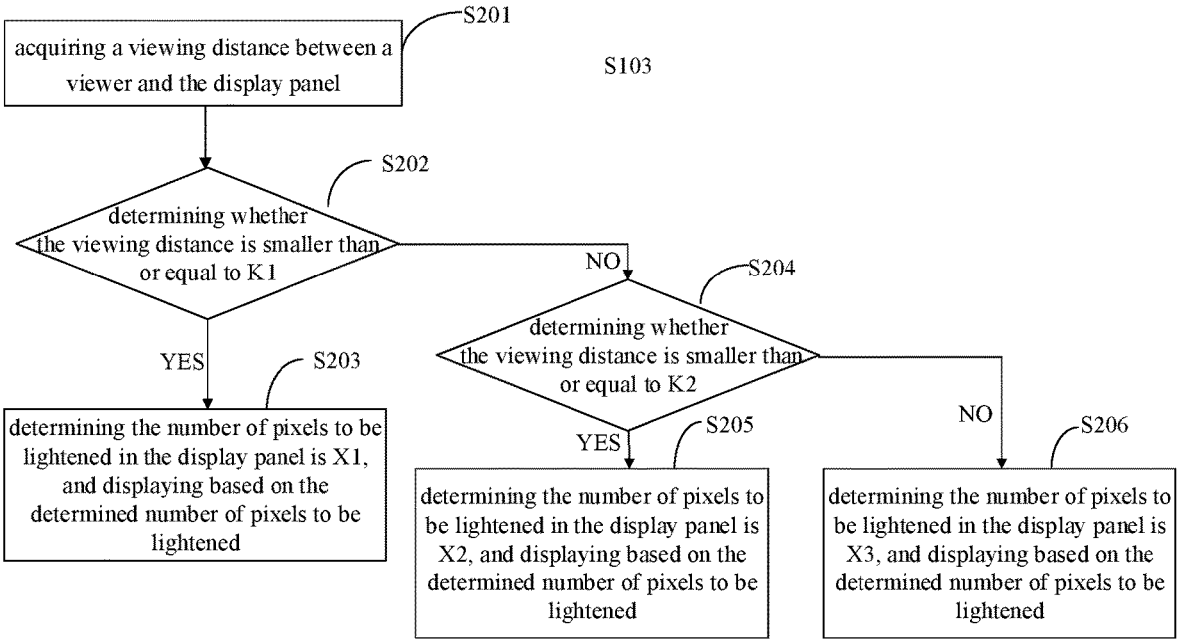
FIG. 3 is a flowchart of a method for driving a display panel according to another embodiment of the present disclosure.

As shown in FIG. 3, the method for driving the display panel described in some embodiments of the present disclosure includes:

S201, a viewing distance between a viewer and the display panel is acquired;

S202, whether the viewing distance is smaller than or equal to K1 is determined;

If yes, S203 is executed, and if not, S204 is executed;

S203, the number of pixels to be lightened in the display panel is determined as X1, and display is performed based on the determined number of pixels to be lightened;

S204, whether the viewing distance is smaller than or equal to K2 is determined; If yes, S205 is executed, and if not, S206 is executed; S205, the number of pixels to be lightened in the display panel is determined as X2, and display is performed based on the determined number of pixels to be lightened;

S206, the number of pixels to be lightened in the display panel is determined as X3, and display is performed based on the determined number of pixels to be lightened.

When the view distance is large, the viewer's resolution requirements for the display panel are not so high as when the viewer watches the display panel at a close range, Therefore, the driving method provided by the embodiment of the present disclosure changes the resolution of the display panel according to the viewing distance, and the larger the viewing distance is, the lower the display resolution of the display panel is, i.e. by reducing the resolution when viewing from a long distance, the energy consumption of the display panel can be reduced without affecting the visual effect of the viewer.

Alternatively, in some embodiments, the step that display is performed based on the determined number of pixels to be lightened includes:

positions of pixels to be lightened are determined based on the determined number of pixels to be lightened; and display is performed based on the positions of pixels to be lightened and a data signal corresponding to the pixels to be lightened.

In some embodiments, when the display resolution is reduced, the display effect is directly affected by the positions of pixels to be lightened. In order to ensure the display effect, the positions of pixels to be lightened will be described in the present disclosure below in embodiments.

Alternatively, in some embodiments, the step that positions of pixels to be lightened are determined based on the determined number of pixels to be lightened includes:

when the number of pixels to be lightened is M/N of the total number of the pixels in the display panel, as shown in FIG. 4 to FIG. 12, every adjacently arranged N pixels 1 are taken as a pixel unit 10, and each pixel unit 10 includes M pixel(s) to be lightened (in figures, shaded pixels are pixels to be lightened); N is an integer greater than 1, and M is a positive integer which is greater than 0 and smaller than N. In this way, the pixels to be lightened can be guaranteed to be distributed uniformly in the display panel, so that the display effect can be guaranteed.

Further, in some embodiments, in each pixel unit, the more uniformly the M pixels to be lightened are arranged, the better the display effect will be.

Figure 4:
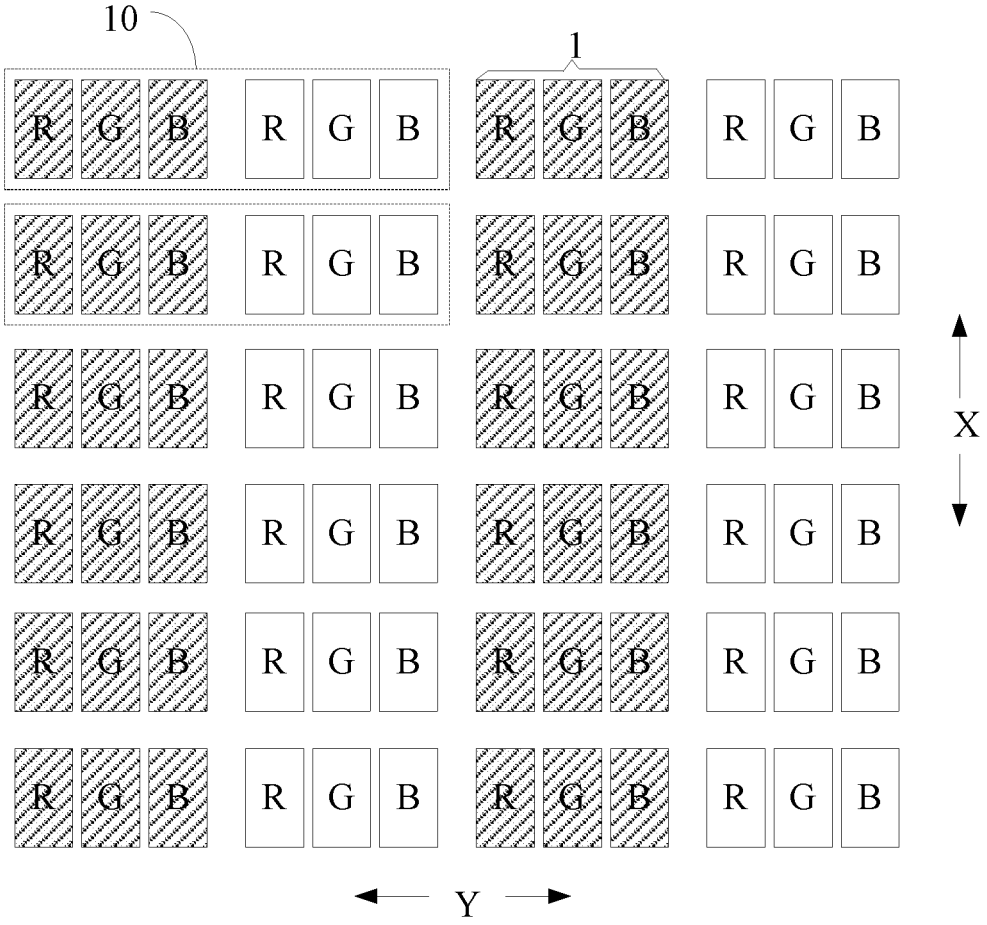
FIG. 4 is a schematic structural diagram of positions of sub-pixels to be lightened when a display panel performs low-resolution display according to another embodiment of the present disclosure.
Figure 5:
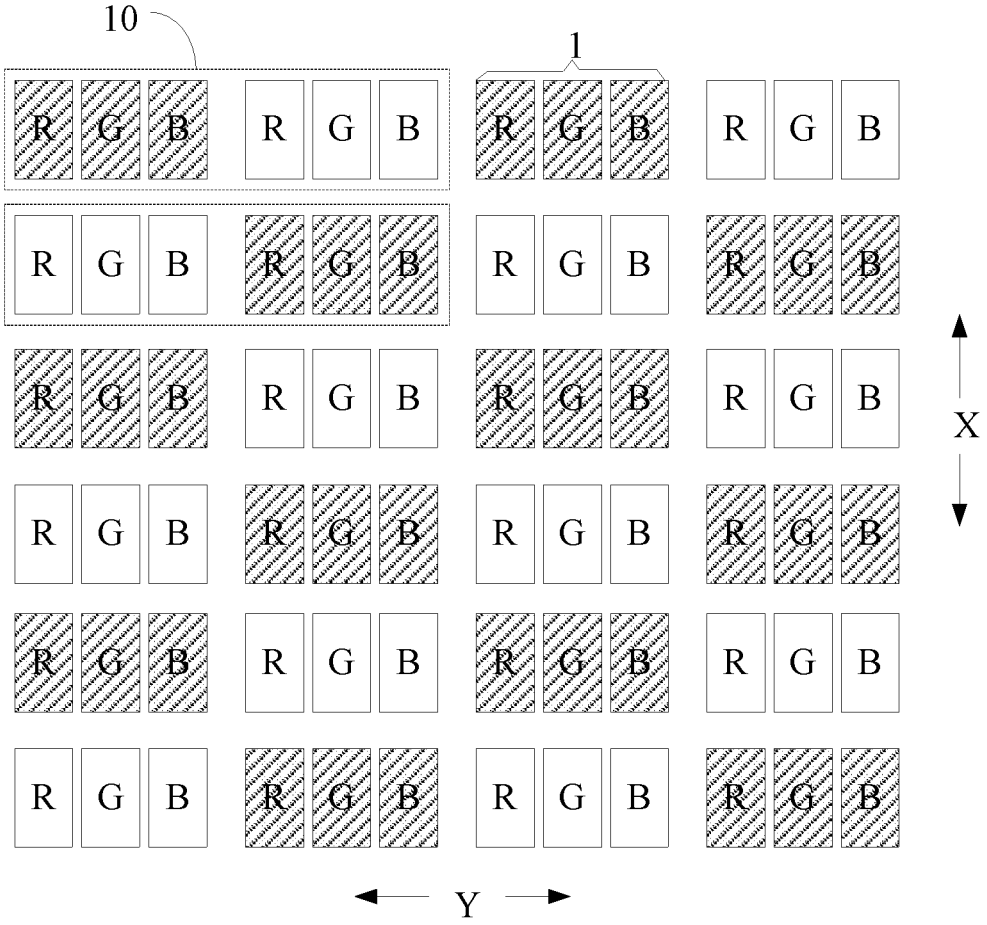
FIG. 5 is a schematic structural diagram of positions of sub-pixels to be lightened when a display panel performs low-resolution display according to yet another embodiment of the present disclosure.
Figure 6:
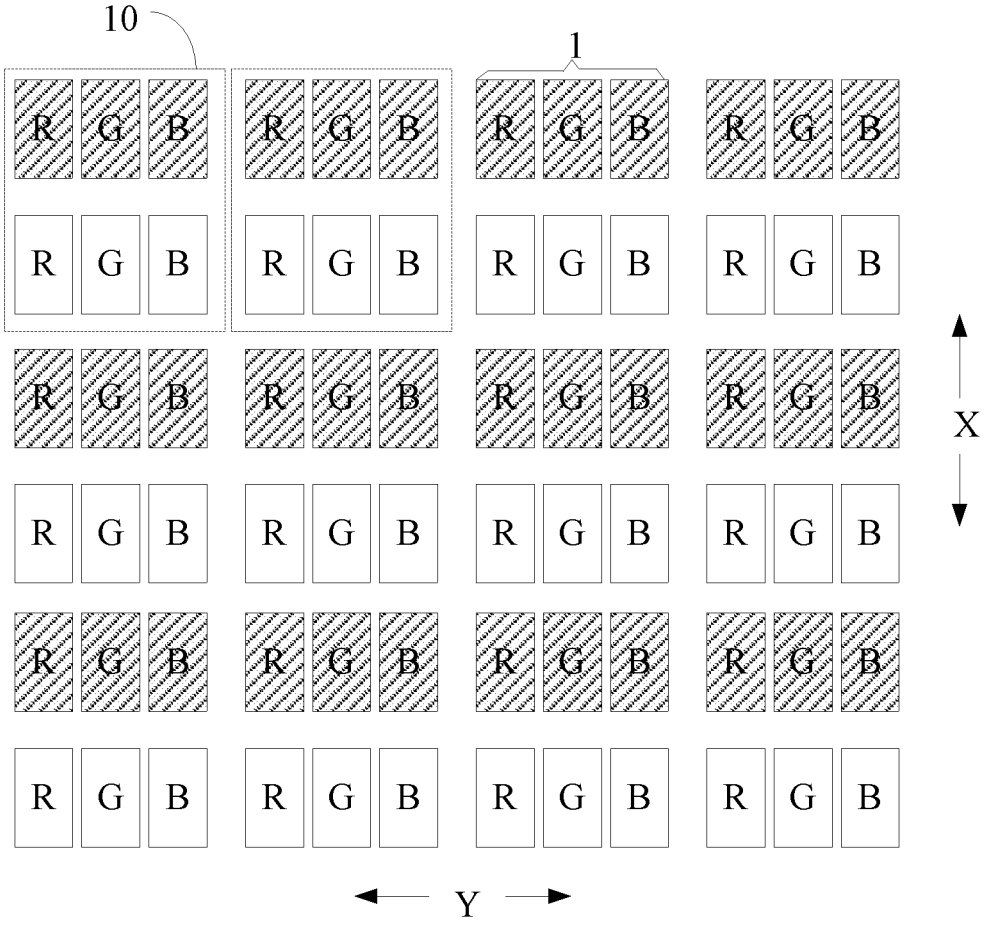
FIG. 6 is a structural diagram of positions of sub-pixels to be lightened when a display panel performs low-resolution display according to yet another embodiment of the present disclosure.
Figure 7:
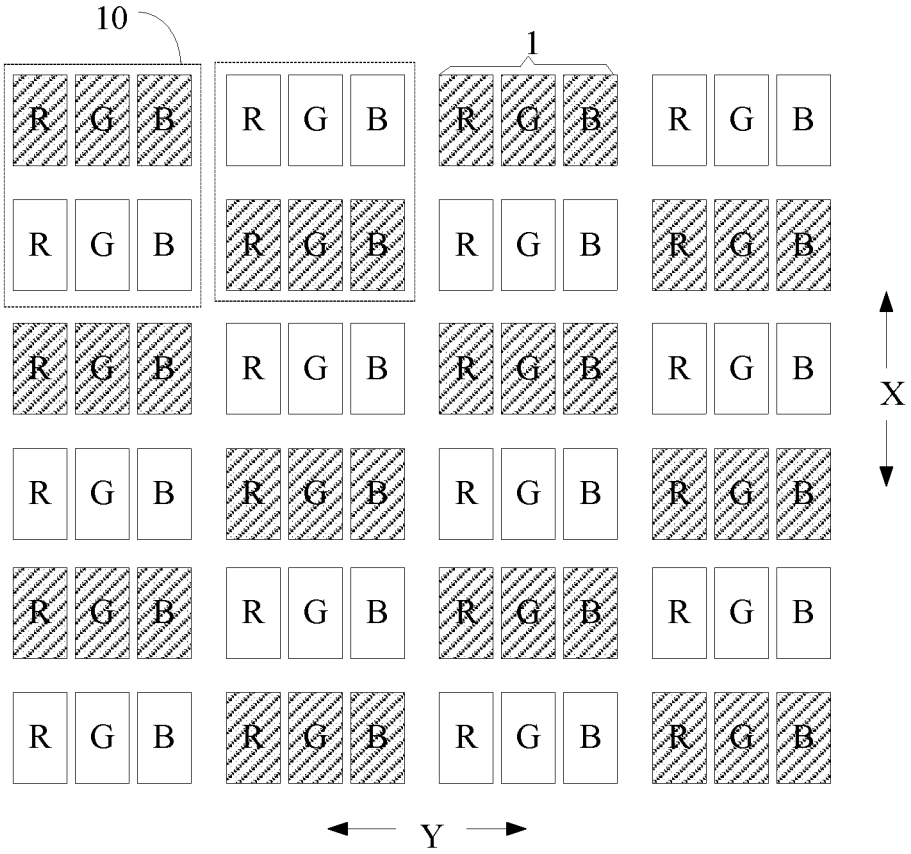
FIG. 7 is a structural diagram of positions of sub-pixels to be lightened when a display panel performs low-resolution display according to yet another embodiment of the present disclosure.
Figure 8:
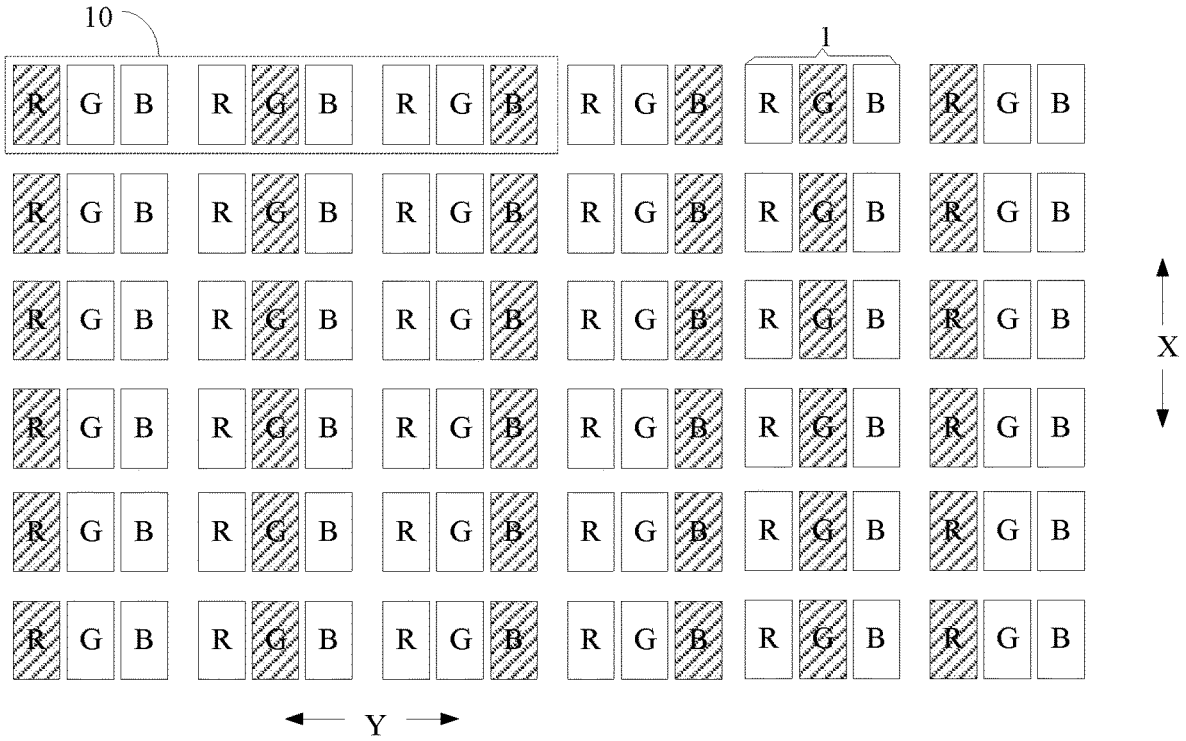
FIG. 8 is a structural diagram of positions of sub-pixels to be lightened when a display panel performs low-resolution display according to yet another embodiment of the present disclosure.
Figure 9:
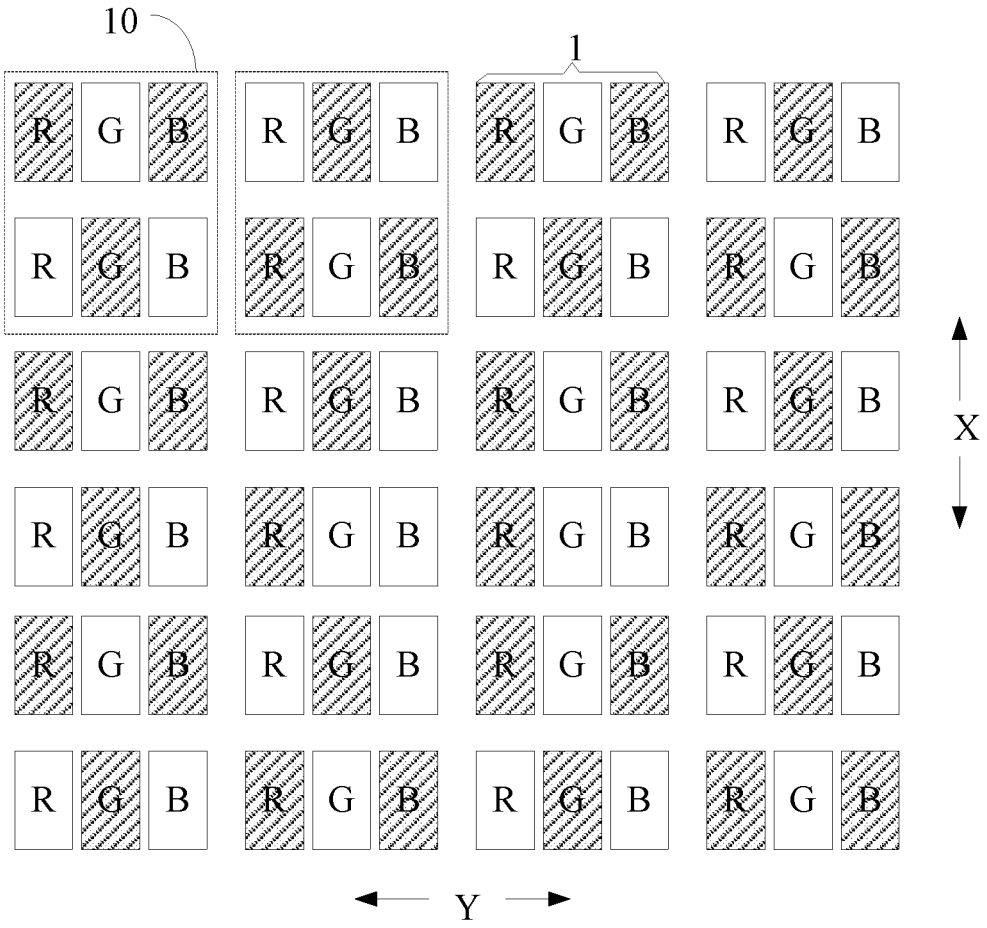
FIG. 9 is a schematic structural diagram of positions of sub-pixels to be lightened when a display panel performs low-resolution display according to yet another embodiment of the present disclosure.
Figure 11:
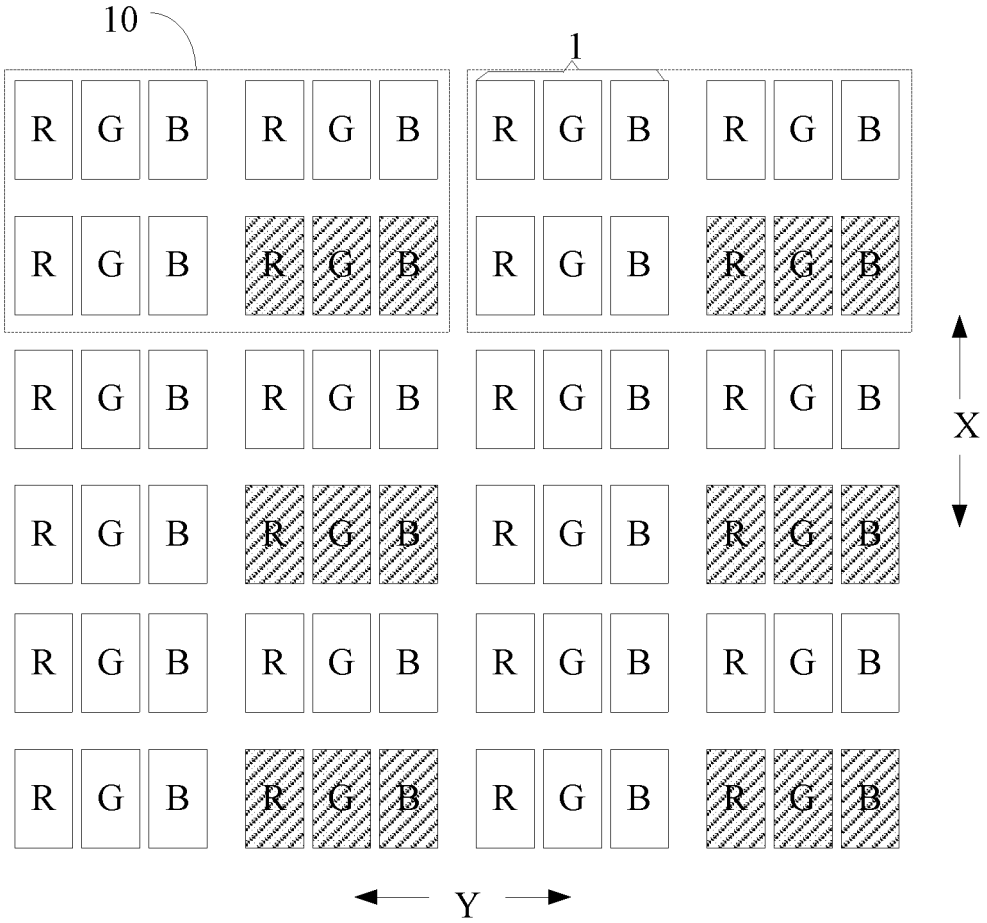
FIG. 11 is a schematic structural diagram of positions of sub-pixels to be lightened when a display panel performs low-resolution display according to yet another embodiment of the present disclosure.
Figure 12:
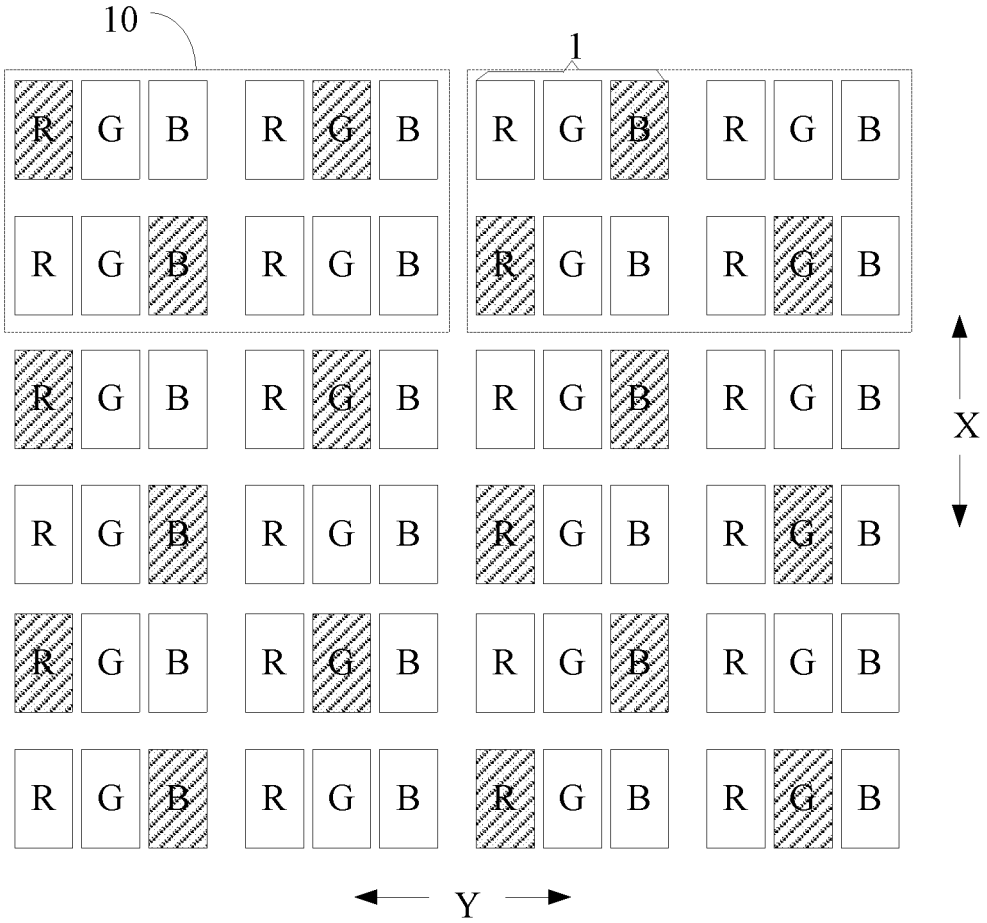
FIG. 12 is a schematic structural diagram of positions of sub-pixels to be lightened when a display panel performs low-resolution display according to yet another embodiment of the present disclosure.

Optionally, as shown in FIG. 4, FIG. 5 and FIG. 8 in some embodiments, N pixels 1 arranged adjacently in each pixel unit 10 can be arranged adjacently in the row direction X; or as shown in FIG. 6, FIG. 7 and FIG. 9, N pixels 1 arranged adjacently in each pixel unit 10 can also be arranged adjacently in the column direction Y; or as shown in FIG. 11 and FIG. 12, N pixels 1 arranged adjacently in each pixel unit 10 can be arranged adjacently both in the row direction X and in the column direction Y, which is not limited in the description here.

It should be noted that, M=1 is taken as an example in the drawings of the description, which will not limit the protection scope of the embodiments of the present disclosure.

Alternatively, in some embodiments, as shown in FIG. 4 to FIG. 7 and FIG. 11, when M=1, each pixel to be lightened is respectively composed of one pixel 1 in the corresponding pixel unit 10.

Further, in some embodiments, as shown in FIG. 4 and FIG. 5, N pixels 1 in the pixel unit 10 are subsequently adjacent in the row direction X. During display, there will be a column of pixels not lightened as shown in FIG. 4, in this way, when the display panel displays, bright lines may easily occur, and the display effect will be affected.

Alternatively, as shown in FIG. 5, in two pixel units 10 adjacent in the column direction Y, two pixels to be lightened are located in different columns. In this way, each row of pixels and each column of pixels can be guaranteed to be lightened, therefore the case that there is a column of pixels not lightened can be avoided and the display effect is guaranteed.

Alternatively, in some embodiments, as shown in FIG. 5, the numbers of the pixels not lightened between any two adjacent pixels to be lightened in the row direction X are same. In this way, the pixels to be lightened can be guaranteed to be uniformly distributed on the display panel, and the display effect is improved.

Alternatively, in some embodiments, as shown in FIG. 6 ad FIG. 7, N pixels 1 in the pixel unit 10 are subsequently adjacent in the column direction Y. During display, there will be a row of pixels not lightened as shown in FIG. 6. In this way, when the display panel displays, bright lines may easily occur, and the display effect will be affected.

Alternatively, as shown in FIG. 7, in two pixel units 10 adjacent in the row direction X, two pixels to be lightened are located in different rows. In this way, each row of pixels and each column of pixels can be guaranteed to be lightened, therefore the case that there is a row of pixels not lightened can be avoided and the display effect can be guaranteed.

Alternatively, in some embodiments, as shown in FIG. 7, the numbers of pixels not lightened between any two adjacent pixels to be lightened in the column direction Y are same. In this way, the pixels to be lightened can be guaranteed to be uniformly distributed on the display panel, and the display effect is improved.

In some embodiments, each sub-pixel in the pixels to be lightened can also belong to different pixels. Alternatively, as shown in FIG. 8, FIG. 9 and FIG. 12, M=1, the pixel to be lightened is composed of sub-pixels in different pixels 1 of the pixel unit 10. In this way, the graininess of display due to resolution reduction will be obviously improved and the softness of picture will be enhanced.

Further, in some embodiments, as shown in FIGS. 9 and 12, the numbers of sub-pixels not lightened between any two adjacent sub-pixels to be lightened in the row direction X are same. In this way, the sub-pixels to be lightened can be guaranteed to be uniformly distributed on the display panel, and the picture texture is improved.

Alternatively, in some embodiments, as shown in FIG. 9, all sub-pixels in the pixel 1 are sequentially arranged along the row direction, and the colors of the sub-pixels in the same column are same.

When N is smaller than the number of sub-pixels included in the pixel 1, the pixel to be lightened is composed of sub-pixels of the N pixels in the pixel unit 10. For example, in FIG. 9, there are 3 sub-pixels in each pixel 1, and the pixel unit 10 includes 2 pixels 1. For the pixels to be lightened in the pixel unit 10, an R sub-pixel and a B sub-pixel belong to one of the pixels 1 in the pixel unit 10. A G sub-pixel belongs to the other pixel 1 of the pixel unit 10. In this way, as shown in FIG. 10, the centers of the three sub-pixels in the pixel to be lightened are connected as a triangle.

Alternatively, in some embodiments, as shown in FIG. 12, all the sub-pixels in the pixel 1 are sequentially arranged along the row direction, and the colors of the sub-pixels in the same column are same.

When N is greater than or equal to the number of sub-pixels included in the pixel 1, the sub-pixels to be lightened of the pixels to be lightened belong to different pixels 1 of the pixel unit 10, respectively. For example, in FIG. 12, each pixel 1 has 3 sub-pixels, and the pixel unit 10 includes 4 pixels 1. Among the pixels to be lightened in the pixel unit 10, an R sub-pixel, a B sub-pixel, and a G sub-pixel belong to different pixels 1 of the pixel unit 10 respectively. In this way, as shown in FIG. 13, the centers of the three sub-pixels in the pixel to be lightened are connected as a triangle.

Figure 10:
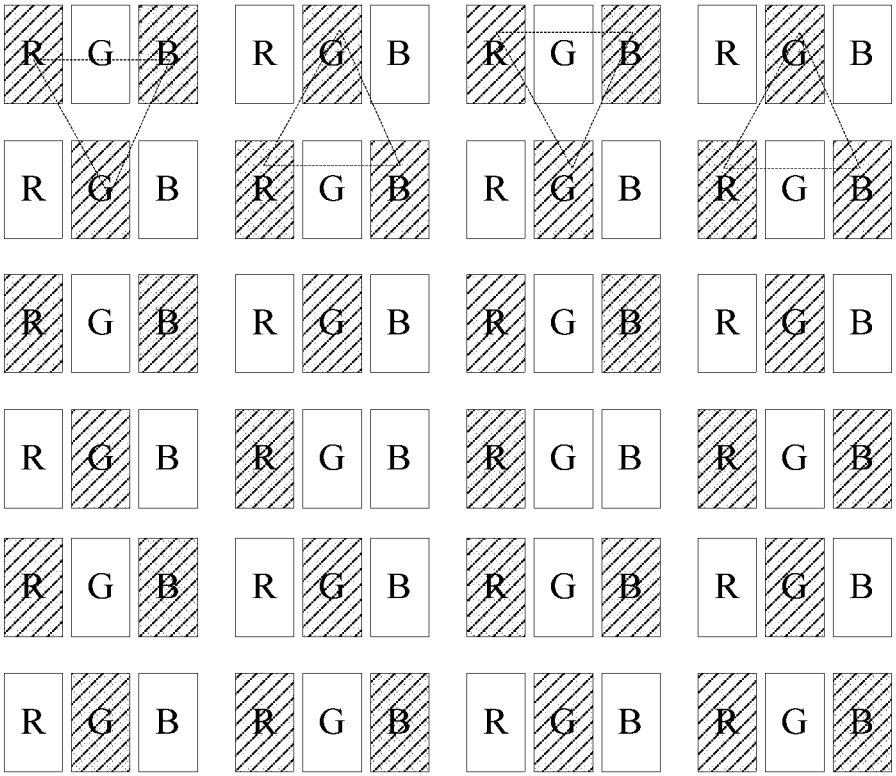
FIG. 10 is a schematic structural diagram of a new pixel structure formed by sub-pixels to be lightened shown in FIG. 9.
Figure 13:
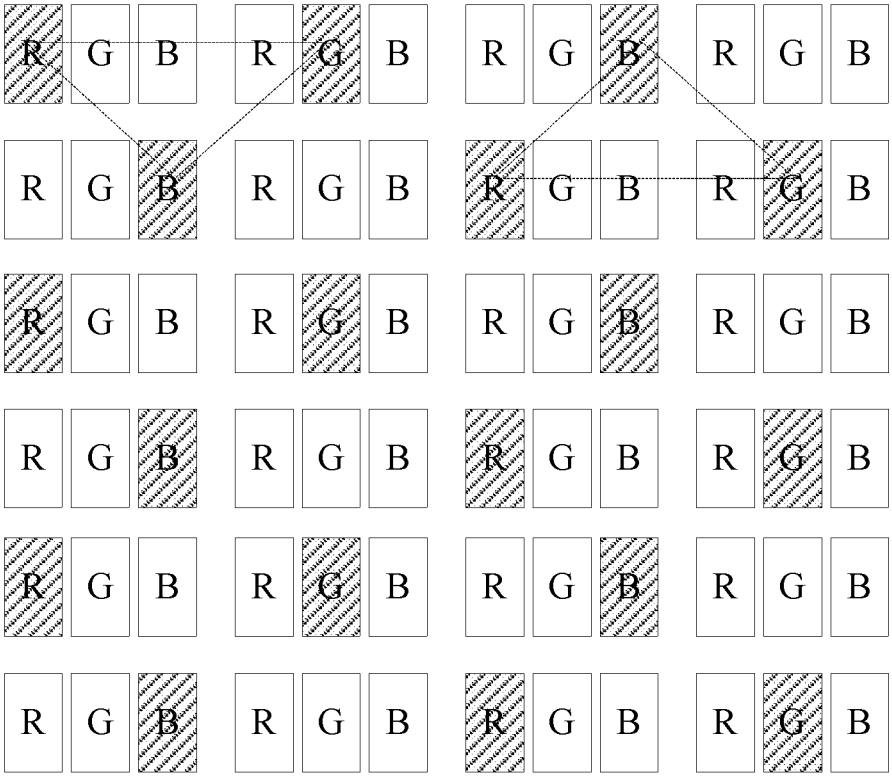
FIG. 13 is a schematic structural diagram of a new pixel structure formed by sub-pixels to be lightened shown in FIG. 12.
Figure 15:
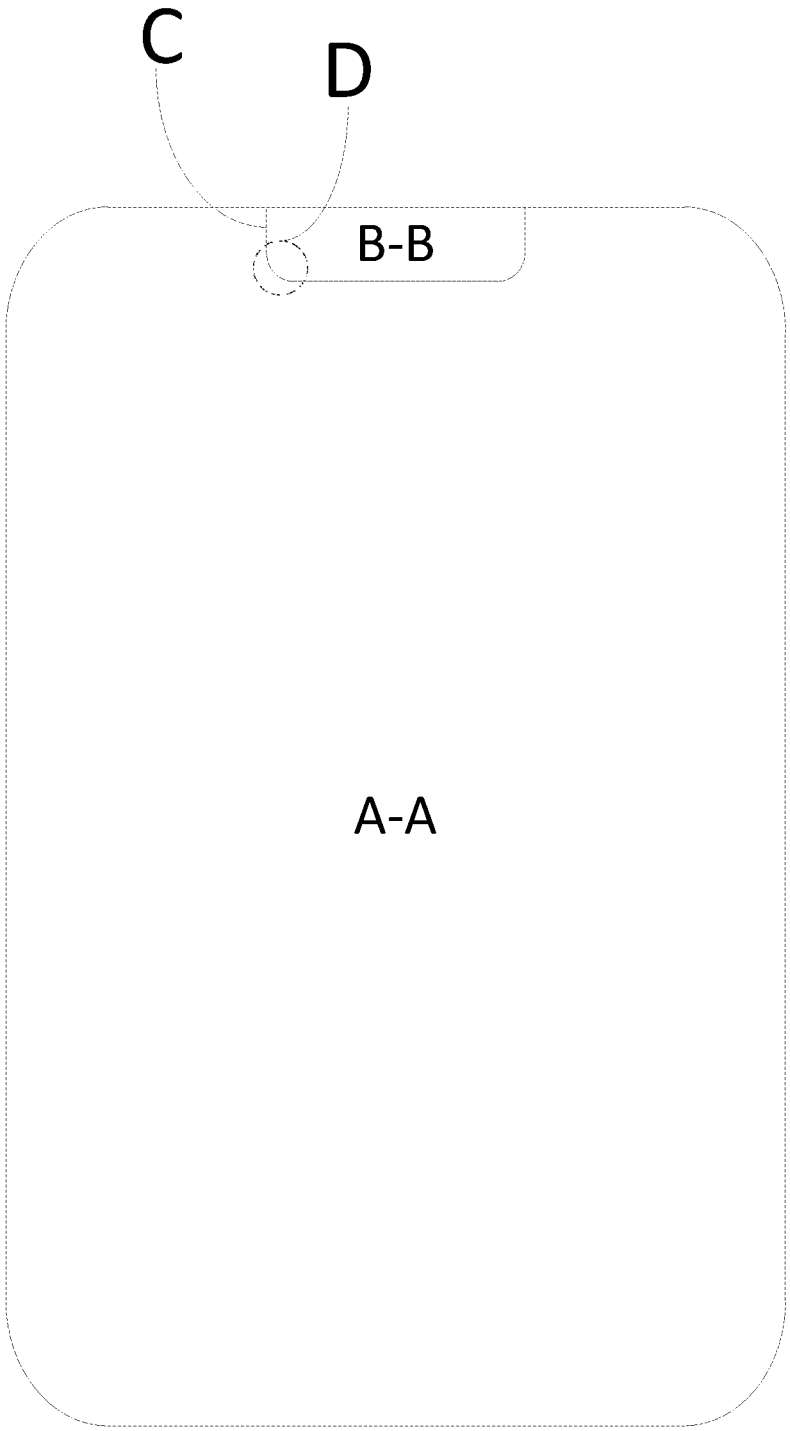
FIG. 15 is a schematic structural diagram of a display panel according to an embodiment of the present disclosure.
Figure 16:
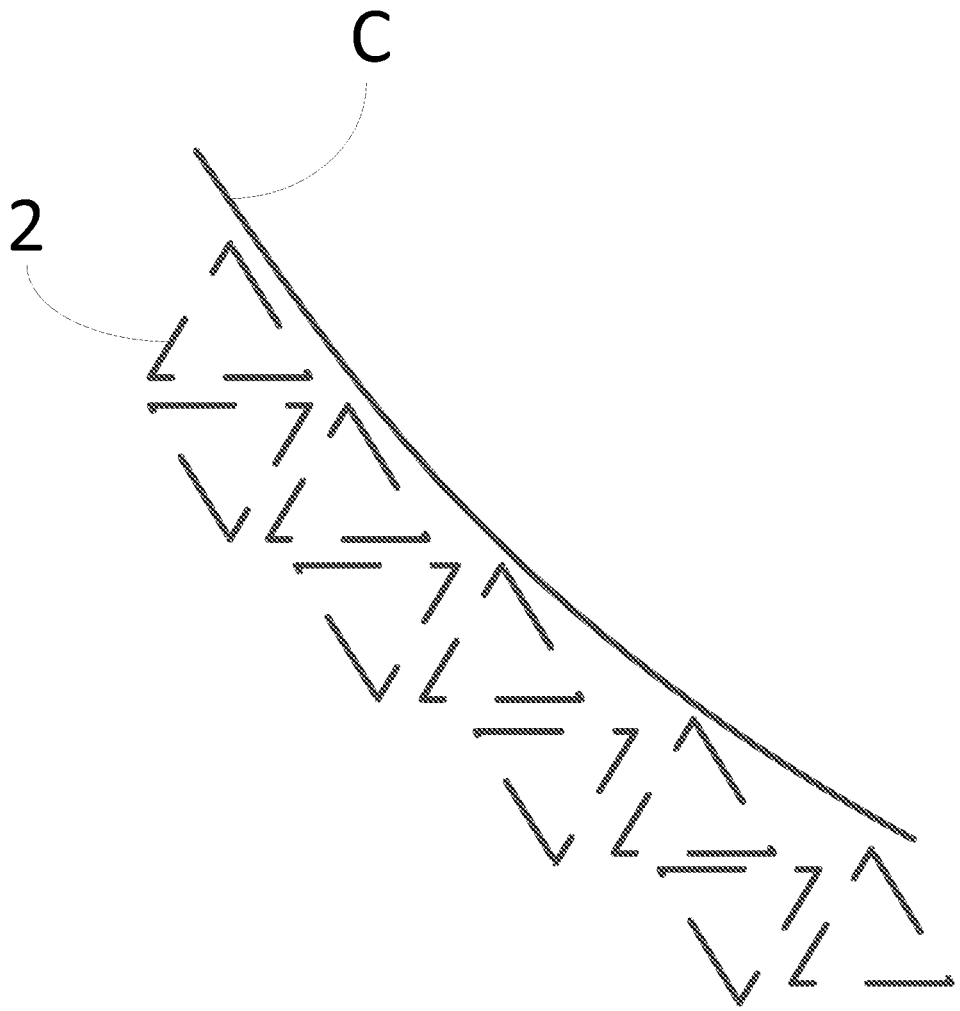
FIG. 16 is a partial enlarged view of the boundary area D between the display area and the abnormal shaped area in FIG. 15.

Optionally, as shown in FIGS. 10 and 13, since the centers of the three sub-pixels in the pixel to be lightened are connected as a triangular, when applied to the display panel as shown in FIG. 15, the display panel includes the display area A-A and the abnormal shaped area B-B, wherein the boundary C between the display area A-A and the abnormal shaped area B-B is arc shaped. As shown in FIG. 16 (FIG. 16 is a partial enlarged view of the area D in FIG. 15), the pixel to be lightened is more conducive to the processing of reducing the power consumption of the abnormal shaped display, thus preventing abnormal "sharp points" on the abnormal shaped edges during consumption-reduced display, and further making the display more smooth. The abnormal shaped area may be a U-shaped groove, a structure including an arc-shaped boundary such as a drop-shaped structure, etc.

Figure 14:
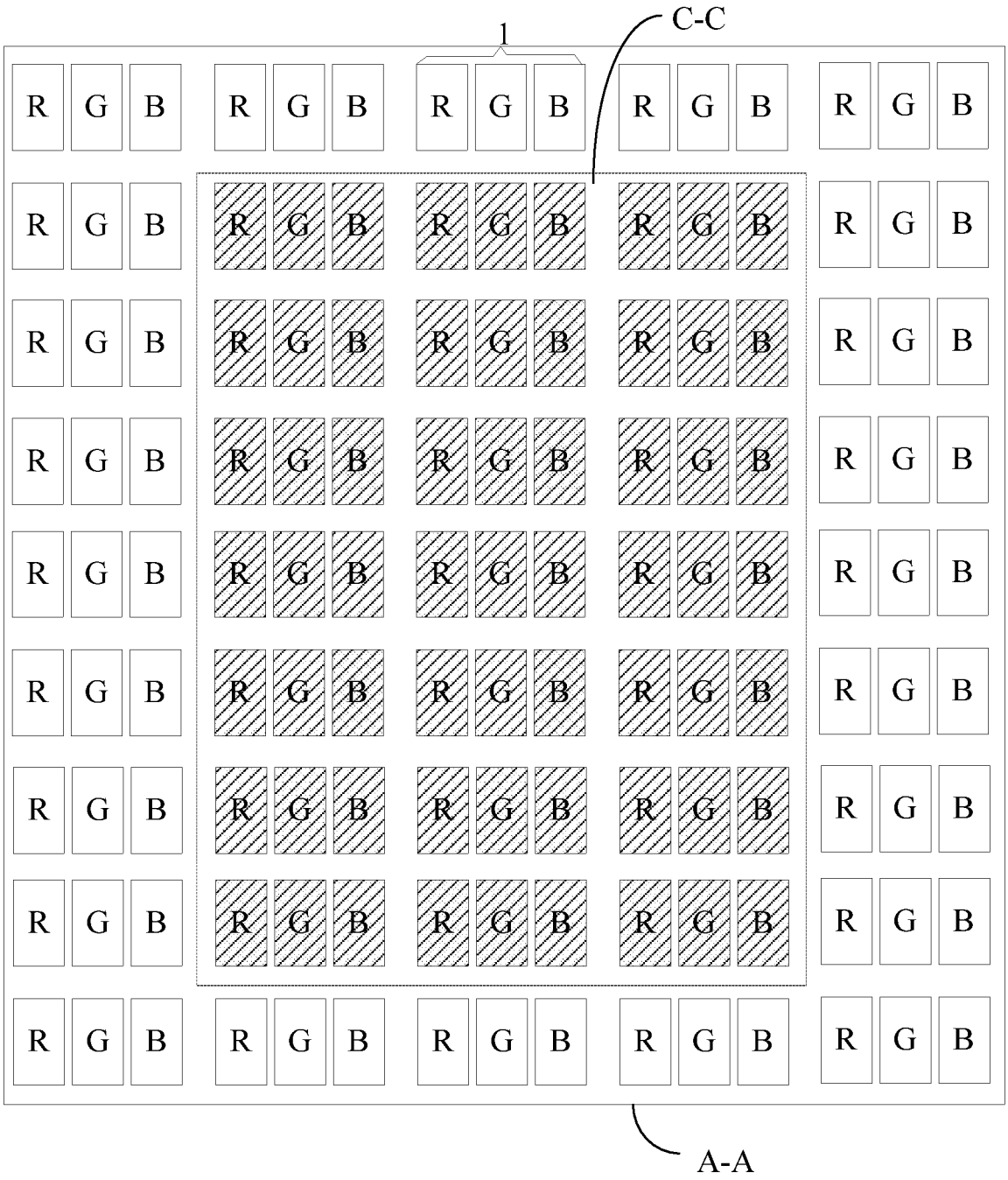
FIG. 14 is a schematic structural diagram of a new pixel structure formed by sub-pixels to be lightened when a display panel performs low-resolution display according to yet another embodiment of the present disclosure.

Alternatively, in some embodiments, the step that the positions of the pixels to be lightened are determined based on the determined number of pixels to be lightened includes: when the number of pixels to be lightened is M/N of the total number of pixels in the display panel, as shown in FIG. 14, the M/N of the area of the display area A-A of the display panel is selected as a area to be displayed C-C, and the shape of the area to be displayed C-C is similar to the shape of the display area A-A of the display panel and the two shapes coincide at center. N is an integer greater than 1, M is an integer greater than 0 and smaller than N. All the pixels 1 in the area to be displayed C-C are the pixels to be lightened. That is, during display, the display area is gradually reduced along with the increase in the viewing distance.

Figure 17:
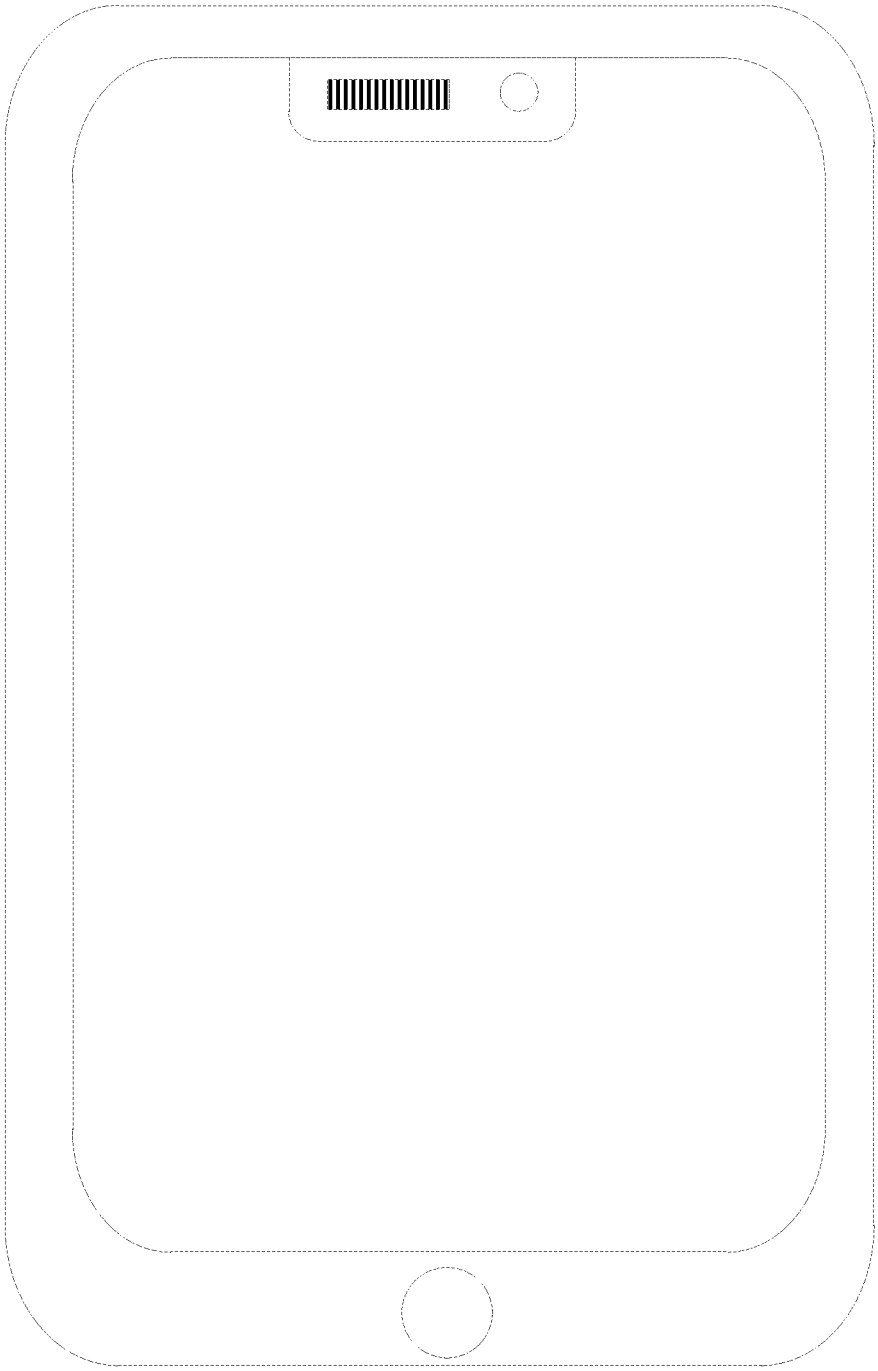
FIG. 17 is a schematic structural diagram of a display device according to an embodiment of the present disclosure.

Based on the same inventive concept, as shown in FIG. 17, an embodiment of the present disclosure also provides a display device, including a display panel driven by the driving method in the above embodiments. Since the principle for solving problem by the display device is similar to the aforementioned driving method of a display panel, the implementation of the display device may refer to the aforementioned method for driving the display panel, and the repetition will not be repeated here.

The display device is suitable for various displays, such as an organic electroluminescent display, an inorganic electroluminescent display, an active matrix/organic light emitting diode (AMOLED) display and the like. The display device may be any product or component with a display function, such as a mobile phone, a tablet computer, a TV, a display, a notebook computer, a digital photo frame, a navigator, or the like, which is not limited herein.

Alternatively, in some embodiments, as shown in FIG. 15, the display panel includes a display area A-A and an abnormal shaped area B-B. At least part of the boundary C between the display area A-A and the abnormal shaped area B-B is arc shaped, wherein, the abnormal shaped area B-B may be a U-shaped groove, a structure including an arc-shaped boundary, such as a drop-shaped structure, and the like.

An embodiment of the present disclosure provides a method for driving a display panel and a display device. The display panel includes a plurality of pixels arranged in an array, and each of the pixels includes sub-pixels of at least three colors. The method includes: a viewing distance between a viewer and a display panel is acquired; the number of pixels to be lightened in the display panel is determined based on the viewing distance; wherein, the larger the viewing distance is, the smaller the number of pixels to be lightened in the display panel is; display is performed based on the determined number of pixels to be lightened. That is, the positions and number of sub-pixels to be lightened in the display panel are determined based on the distance between the viewer and the display panel. The display panel performs high-resolution display when the distance is relatively close, and the display panel performs low-resolution display when the distance is relatively far, so as to reduce the energy consumption of the display panel.

It is apparent that those skilled in the art can make various modifications and variations to the present disclosure without departing from the spirit and scope of the present disclosure. In this way, if these modifications and variations of the present disclosure fall within the scope of the claims of the present disclosure and equivalent technologies thereof, the present disclosure is intended to include these modifications and variations as well.

What is claimed is:

1. A method for driving a display panel, the display panel comprises a plurality of pixels arranged in an array, and each of the pixels comprising sub-pixels of at least three colors, wherein the method comprises:

acquiring a viewing distance between a viewer and the display panel;

determining a quantity of pixels to be lightened in the display panel based on the viewing distance; wherein larger the viewing distance is, smaller the quantity of pixels to be lightened in the display panel is; and displaying based on determined quantity of pixels to be lightened;

wherein the determining the positions of pixels to be lightened based on the determined quantity of pixels to be lightened comprises:

in response to that the quantity of pixels to be lightened is M/N of a total quantity of pixels in the display panel, grouping every adjacently arranged N pixels as a pixel unit, and each of the pixel units comprise M pixels to be lightened; wherein N is an integer greater than 1, and M is a positive integer smaller than N; or in response to that the quantity of pixels to be lightened is M/N of the total number of pixels in the display panel, selecting a region to be displayed, wherein an area of the region to be displayed is M/N of an area of a display region of the display panel, and a shape of the region to be displayed is similar to a shape of the display region, and the two shapes coincide at center; N is an integer greater than 1 and M is a positive integer smaller than N; wherein the pixels to be lightened comprises the pixels in the region to be displayed.

2. The method according to claim 1, wherein the determining the quantity of pixels to be lightened in the display panel based on the viewing distance comprises:

determining the quantity of pixels to be lightened in the display panel based on the viewing distance and a corresponding relationship between preset distance ranges and quantities of pixels to be lightened;

wherein the quantities of pixels to be lightened corresponding to the preset distance ranges are different, and larger the distance range is, smaller the quantity of the pixels to be lightened is.

3. The method according to claim 2, wherein the determining the quantity of pixels to be lightened in the display panel based on the viewing distance and the corresponding relationship lightened comprises:

determining a distance range to which the viewing distance belongs; and determining the quantity of pixels to be lightened in the display panel by searching the corresponding relationship between the preset distance ranges and the quantities of pixels to be lightened based on determined distance range.

4. The method according to claim 1, wherein the displaying based on the determined quantity of pixels to be lightened comprises:

determining positions of pixels to be lightened based on the determined quantity of pixels to be lightened; and displaying based on the positions of pixels to be lightened and a data signal corresponding to the pixels to be lightened.

5. The method according to claim 1, wherein M=1, and the pixel to be lightened is composed of one of the pixels in the pixel unit.

6. The method according to claim 5, wherein the N pixels in the pixel unit are sequentially adjacent in a row direction; and in two pixel units adjacent in a column direction, two pixels to be lightened are located in different columns.

7. The method according to claim 6, wherein a quantity of non-lightened pixels between any two adjacent pixels to be lightened in the row direction are same.

8. The method according to claim 5, wherein N pixels in the pixel unit are sequentially adjacent in a column direction; and in two pixel units adjacent in the row direction, the two pixels to be lightened are located in different rows.

9. The method according to claim 8, wherein quantities of non-lightened pixels between any two adjacent pixels to be lightened in the column direction are same.

10. The method according to claim 1, wherein M=1, and the pixel to be lightened is composed of sub-pixels in different pixels in the pixel unit.

11. The method according to claim 10, wherein quantities of non-lighten sub-pixels lightened between any two sub-pixels to be lightened adjacent in a row direction are same.

12. The method according to claim 10, wherein all the sub-pixels in the pixels are subsequently arranged in the row direction, and the sub-pixels in a same column have same color; and in response to that N is smaller than the quantity of sub-pixels in the pixel, the pixel to be lightened is composed of sub-pixels of the N pixels in the pixel unit.

13. The method according to claim 10, wherein all the sub-pixels in the pixels are sequentially arranged in the row direction, and the sub-pixels in a same column the same color; and in response to that N is greater than or equal to the quantity of sub-pixels in the pixel, the sub-pixels to be lightened belong to different pixels of the pixel units, respectively.

14. A display device, comprising a display panel, wherein the display panel is driven by the method according to claim 1.

15. The display device according to claim 14, wherein the display panel comprises the display region and an abnormal shaped region, and a boundary line between the display region and the abnormal shaped region is at least partially arc shaped.

* * * * *